United States Patent [19]

Keogh, Sr. et al.

[11] 4,040,381

[45] Aug. 9, 1977

[54] VISUAL BURGLAR ALARM

[76] Inventors: Gerard G. Keogh, Sr.; Gerard G. Keogh, Jr., both of 1101 Concordia Drive, Towson, Md. 21204

[21] Appl. No.: 672,845

[22] Filed: Apr. 2, 1976

[51] Int. Cl.[2] ..... G08B 13/08

[52] U.S. Cl. ..... 116/86; 116/114 K; 337/207

[58] Field of Search ..... 116/96, 85, 86, 75, 116/77, 100, 97, 114, 114 K, 114 R; 335/207; 340/274

[56] References Cited

U.S. PATENT DOCUMENTS

| | | | |
|---|---|---|---|
| 2,600,581 | 6/1952 | Schenendorf | 340/274 |
| 3,448,620 | 6/1969 | Ryan | 116/114 R |
| 3,516,036 | 6/1970 | Lea | 116/85 X |
| 3,915,112 | 10/1975 | Forester | 116/114 K |

*Primary Examiner*—Richard C. Queisser
*Assistant Examiner*—Daniel M. Yasich
*Attorney, Agent, or Firm*—John F. McClellan, Sr.

[57] ABSTRACT

A visual burglar alarm in the form of a mechanism for indicating that a door has been opened at least once during the absence of the occupant and therefore that caution should be exercised by the occupant in entering the room closed off by the door; the mechanism includes a tubular housing having a constriction narrowing a portion of the bore, means for attaching the tubular housing upright at the upper margin of a door, a magnet loosely held in the bore above the constriction, a non-magnetic shank extending down from the magnet and loosely passing through the constriction, and means for causing the magnet to adhere at the door jamb when thrust up from below by pressure on the lower end of the shank, so that when the door opens the magnet falls and gives indication of intrusion.

13 Claims, 10 Drawing Figures

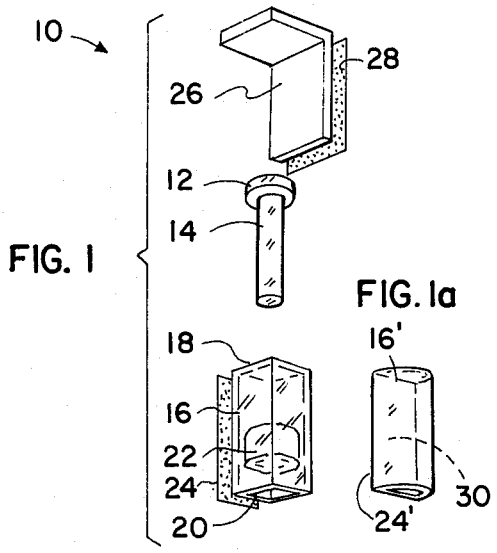
FIG. 1
FIG. 1a
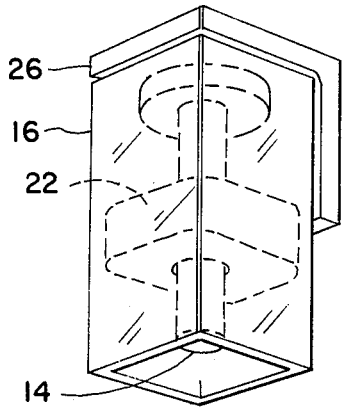
FIG. 2
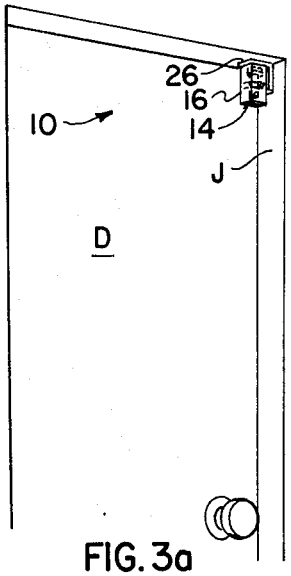
FIG. 3a
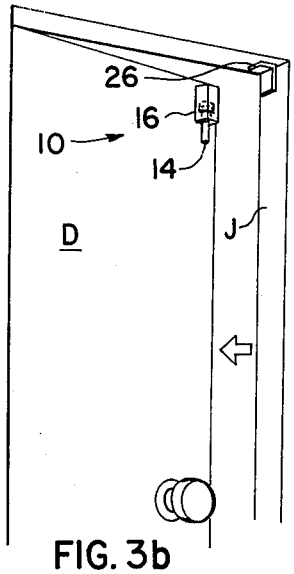
FIG. 3b
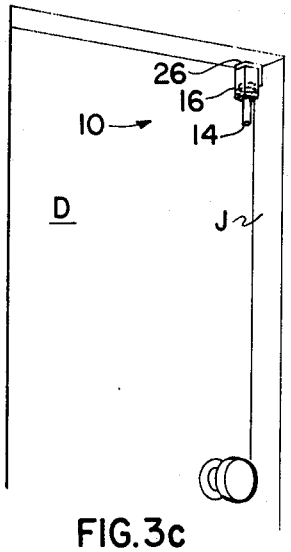
FIG. 3c
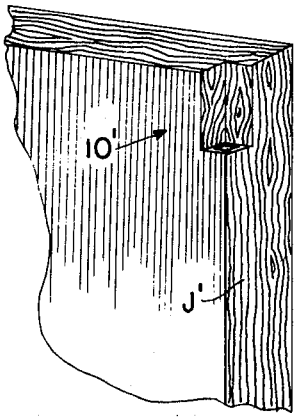
FIG. 4
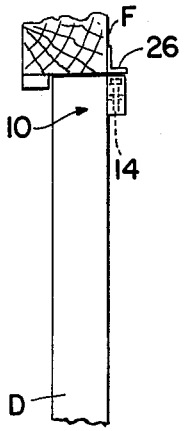
FIG. 5a
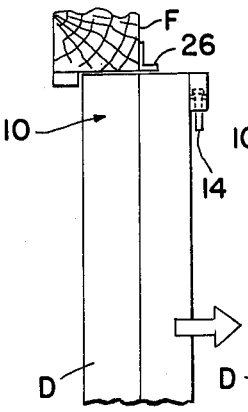
FIG. 5b
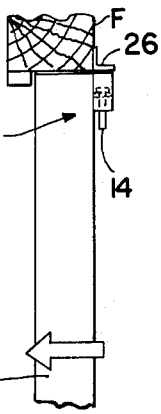
FIG. 5c

VISUAL BURGLAR ALARM

This invention relates generally to burglar alarms and specifically to a magnetically supported visual alarm for installation in a doorway.

Apartment dwellers, homeowners and workers in isolated locations who leave the vicinity of a closed room sometimes found on returning and re-entering that a burglar, robber, rapist or other unauthorized person is lying in wait for them. Usually such intruders operate singly and at any time of day or night at which they can enter unobserved. Locks on doors do not always stop them and doors which must be left unlocked, as during business hours, are an open invitation. p Accordingly, a principal object of this invention is to help the potential victims, such as the office secretary returning from the restroom, the apartment dweller returning from the laundry room, the homeowner returning from shopping, or the child returning from school, by providing an inconspicuous means for indicating that the door through which they must enter, has or has not been opened since they left. On finding that the door has been opened during their absence, they can seek help before entering or otherwise exercise caution. On observing that the door has not been opened, they can feel the comfort of this assurance.

A further object is to provide a device for the purposes described which is virtually impossible for a sole intruder to reset from inside the room, and which is self-checking so that the owner can observe that it has not been jammed by an intruder.

Still a further object is to provide a device which can be installed with little cost and skill on almost any human-access door, which can be operated with ease by almost anyone, which is inconspicuous in appearance, reliable in operation, and which requires no maintenance.

In brief summary given for cursive description only and not as limitation, the invention provides structure including a device fixed to a first portion of a doorway and having magnet constrained to rise and fall in a tubular housing, the magnet adhering at a second portion of the first and second portions of the doorway.

The above and other objects and advantages of this invention will become more readily apparent on examinatin of the following description, including the drawings, in which like reference numerals indicate like parts:

FIG. 1 is an exploded isometric view;

FIG. 1*a* is an isometric view;

FIG. 2 is an enlarged isometric view of the elements of the earliest Figure in installed relation FIGS. 3*a, b* and *c* are successive-position isometric views of the invention installed in an inward-opening-door doorway;

FIG. 4 is an isometric view of the invention installed in alternative mode in a metal frame doorway; and FIG. 5*a, b* and *c* are successive-position elevational views of the invention installed in an outward-opening-door doorway shown partly in section.

STRUCTURE

FIG. 1 shows magnet assembly 10 consisting of a magnetic disk or magnet 12 having a preferably non-magnetic shank 14 which may advantageously be a transparent plastic rod, cemented or otherwise suitably affixed to the magnet. A preferably non-magnetic tubular housing 16 which may be of transparent plastic or the like, has an open top and bottom 18, 20, and means such as a section of smaller tubing 22 coaxially fixed within it to constrict the lower portion of the bore of the tubular housing. Double-faced self-adhesive tape 24 or other suitable means is provided for securing the tubular housing to a door, and for this, square-cross section tubing is provided, giving a flat mounting surface.

Steel or other ferrous angle 26 is used as means for attracting the magnet when installation is to be made to a non-magnetic door frame, double-faced self-adhesive tape 28 being provided for the purpose on the outer portion of one of the right-angle related legs of the steel angle. This leg may be about one inch long. For some applications adhesive may be supplied on both legs.

For purposes of illustration the unit is exaggerated in size in the Figures. In actual embodiment it is smaller then shown, and can be made less than an inch in length and in width. FIG. 1*a* shows that, alternatively, half-round sectional shape may be employed for the housing 16', providing both a flat mounting surface 30 with tape 24', and appearance and viewing advantages in some applications.

FIG. 2 shows the relation of the parts of the invention when in one operating relation; the magnet adhering to the steel angle 26 and holding the non-magnetic shank 14 in the up position with the lower end recessed in the tubular housing.

INSTALLATION

FIG. 3*a* shows the invention 10 installed for use on an inward-opening-door doorway which might be a doorway opening into an apartment from a common hallway. The invention preferably is installed at the swinging side of the door to offer maximum protection by indicating the least opening of the door. The tubular housing 16 carrying the magnet-and-shank assembly inside is affixed to the upper margin of the door D. The steel angle 26 is affixed to the door jamb J in position with a leg of the steel angle closely overhanging but not touching the tubular housing.

OPERATION

As shown in this Figure, when leaving the apartment with no one inside, the occupant presses upward on the magnet assembly shank 14, lifting the magnet assembly and causing the magnet to adhere to the steel angle 26 in the position shown. People who because of age, infirmity or other reasons cannot reach the unit directly, can lift the magnet assembly with an umbrella, a rolled-up newspaper, a purse, or any other convenient object, ferrous or otherwise since the magnet assembly shank is non-magnetic and requires little effort to lift. FIG. 3*b* indicates how an intruder on opening the door causes the magnet assembly to drop. On reclosing the door from the inside the intruder has no way to reset the magnet assembly in the upward position even if he notices the unit on entering. The length of smaller tubing used may be soft, such as "Koroseal" brand polyvinyl chloride tubing so that the magnet assembly is cushioned and makes practically no noise at all in falling. If an audible signal is desired harder material may be used.

FIG. 3*c* indicates the visual alarm of intrusion given by the fallen magnet assembly, particularly the shank 14 which protrudes downward well below the tubular container. The returning occupant seeing this can take necessary precautions prior to entering.

FIG. 4 shows in larger view an embodiment 10' like that described, but in use with a doorway having a steel jamb J'. In this case the steel angle provided need not be used, the magnet assembly adhering to the steel door jamb. Also indicated in the Figure is wood-graining effect on the unit representing any finish matching similar effect on the door-way in which installed, further rendering the unit unnoticeable. Position of the magnet shank is observable from below regardless of the finish.

ARRANGEMENT FOR OUTWARD OPENING DOORS

FIGS. 5*a*, 5*b* and 5*c* show installation and in successive positions operation of the invention 10 installed on the outside of a door opening outward from a room. The tubular container is mounted as before at the upper margin of the door. The steel angle 26 is installed against the facing F of the jamb with one leg out, overhanging the tubular container.

As before, when the door opens, the magnet drops, giving indication directly and/or by protrusion of the shank 14 of intrusion from any distance the unit can be observed, and cannot be reset by a single intruder who has passed through the door and remains in the room.

Once set, also, the unit resists pranksters who would pull it into the alarm position by means of a magnet, since the shank is nonmagnetic. Jamming the magnet assembly in the "up" position is very difficult without leaving visual evidence, since the unit in preferred embodiment is made of transparent material to display any foreign object forced into it. In any event, the unit self-checks by dropping freely when the occupant returns and opens the door a slight distance.

In conclusion, it can be seen that the invention employs a minimum number of parts, all of which are commercially available in bulk and at very low cost, to provide an easily installed, easily operated silent visual burglar alarm, unobtrusive in appearance and reliable in operation. Double face tape installation is entirely non-destructive, making feasible installation in all rented spaces or even in temporarily occupied spaces such as motel rooms, and the unit is so light that tape holds it indefinitely and securely to most, if not all, surfaces.

Flexibility to fit most doorways and door types is provided; for example sliding door installations would be identical to the first and last closed-door installations pictured. For overhanging steel frame doorways, the angle should be used, providing for a gap between the magnet and the frame when the door is moved. The rectangular tubular housing not only protects the magnet assembly from tampering, and gives the unit a pleasing external appearance in many locations where it might be observed but also may extend downward to cover as much of the magnet shank in the fallen position as may be desired, while still affording from below visual access and finger access for lifting the magnet. In the transparent embodiment, all-angle visibility of magnet position is provided, even from above, as when the occupant may be descending stairs and looking below.

This invention is not to be construed as limited to the particular forms disclosed herein, since these are to be regarded as illustrative rather than restrictive. It is, therefore, to be understood that the inventin may be practiced within the scope of the claims otherwise than as specifically described.

What is desired to be secured and protected by United States Letters Patent is:

1. A burglar alarm for installation on a doorway having relative opening and closing motion between first and second parts of the doorway, comprising: a housing for upright installation of a first part of a doorway, a magnet, said housing having a bore therein, means intermediate said housing for retaining the magnet within the housing, said means intermediate of the housing forming a constriction of said bore within said housing, means for lifting the magnet comprising a shank affixed to the magnet; means locatable on said second part of a doorway for causing the magnet when lifted to adhere magnetically adjacent said second part of a doorway, to fall within the housing on said relative opening motion between first and second parts of a doorway and to remain in the fallen position upon doorway reclosure; and means for affording visual indication of the position of the magnet with respect to the housing.

2. A burglar alarm as recited in claim 1, the shank being of non-magnetic material and having a portion dimensioned for extending downward through the constriction and, in said fallen position, protruding for providing access to the shank.

3. A burglar alarm as recited in claim 2, the means for affording visual indication of the position of the magnet comprising at least a portion of the housing being of transparent material.

4. A burglar alarm as recited in claim 2, the means for affordingvisual indication of the position of the magnet comprising the housing being a length of transparent tubing.

5. A burglar alarm as recited in claim 2, the housing having an open top and bottom and having therein a tubular structure forming sad constriction.

6. A burglar alarm as recited in claim 5, and means for cushioning at said tubular structure the fall of the magnet.

7. A burglar alarm as recited in claim 2, the housing having a squared cross-sectional shape open at the top, and means on an exterior portion of the housing for affixing the housing to a first portion of a doorway with the open top adjacent said second portion of a doorway.

8. A burglar alarm as recited in claim 2, the housing having half-round cross-sectional shape providing a flat mounting surface, and means for affixing the flat mounting surface to a first portion of a doorway.

9. A burglar alarm as recited in claim 8, said means for affixing comprising a self-adhesive layer.

10. A burglar alarm as recited in claim 1, the means for causing the magnet to adhere magnetically comprising a ferrous member, and means for mounting the ferrous member above the housing.

11. A burglar alarm as recited in claim 10, the means for mounting the ferrous member comprising self-adhesive on a portion thereof.

12. A burglar alarm as recited in claim 10, the means for causing the magnet to adhere magnetically comprising a ferrous angle having first and second legs joined at substantially a right angle.

13. A burglar alarm as recited in claim 12, and means for mounting the ferrous angle, including self-adhesive on an exterior surface of one of said legs.

* * * * *